United States Patent [19]

McMillan et al.

[11] Patent Number: 4,637,231

[45] Date of Patent: Jan. 20, 1987

[54] CLOTHES WASHING MACHINE INCLUDING A HIGH DETERGENT CONCENTRATION WASH CYCLE

[75] Inventors: Stephen L. McMillan, Louisville; Alvin Akers, Jeffersontown, both of Ky.; Daniel N. Toma, Georgetown, Ind.

[73] Assignee: General Electric Company, Louisville, Ky.

[21] Appl. No.: 742,032

[22] Filed: Jun. 6, 1985

[51] Int. Cl.[4] ..... D06F 31/00; D06F 33/02

[52] U.S. Cl. ..... 68/4; 68/12 R; 68/27

[58] Field of Search ..... 68/4, 12 R, 27

[56] References Cited

U.S. PATENT DOCUMENTS

| | | | |
|---|---|---|---|
| 3,014,358 | 12/1961 | Bochan | 68/4 |
| 3,091,107 | 5/1963 | Rhodes | 68/4 |
| 3,324,688 | 6/1967 | Hubbard | 68/4 |
| 3,481,162 | 12/1969 | Ziegler | 68/4 |
| 3,575,020 | 1/1969 | Hubbard | 68/4 |
| 4,175,409 | 11/1979 | Morey | 68/4 |

*Primary Examiner*—Philip R. Coe

*Attorney, Agent, or Firm*—Frank P. Giacalone; Radford M. Reams

[57] ABSTRACT

This invention relates to automatic clothes washing machines, and more particularly to an improved structure in such machines for affecting the washing of very small loads of clothing in a high detergent concentration. The clothes washing machine has wash, rinse and spin extraction operations including an outer imperforate tub, an agitator, a first basket within the tub, a second smaller basket disposed within the first basket and positioned on the agitator for movement therewith. There is also a water supply for feeding water into the machine, drive system for operating the agitator to effect washing of clothes and for rotating the basket to centrifugally extract water from the clothes. Water is allowed to flow from the basket to the tub and may be recirculated from the tub into the baskets. The improvement is a controlled recirculation system wherein only a predetermined volume of water is transferred from the outer tub to the small basket by the recirculation system. This allows clothes placed in the small basket to be washed in a high detergent concentration relative to the predetermined volume of water in the small basket and independent of the amount of water in the tub and to then be rinsed during continuous recirculation of water from the outer tub.

4 Claims, 3 Drawing Figures

CLOTHES WASHING MACHINE INCLUDING A HIGH DETERGENT CONCENTRATION WASH CYCLE

BACKGROUND OF THE INVENTION

The present invention relates to automatic clothes washing machines and more particularly to an improved structure in such machines for effecting the washing of relatively small loads of clothing and especially heavily soiled clothing in a high detergent concentration.

Automatic clothes washing machines customarily provide, in a clothes basket adapted to hold several pounds of clothes, a sequence of operations in order to wash, rinse and extract water from the clothes in the basket. The sequence ordinarily includes a water fill followed by a washing operation which, in a vertical axis type machine, is provided by an agitator movably arranged to oscillate within the basket; a first centrifugal extraction operation in which the wash water is removed from the clothes by spinning the basket; another water fill followed by a rinsing operation in which the clothes are rinsed in clean water while the agitator is oscillated; and a final centrifugal liquid extraction operation in which the basket is spun to remove rinse water from the clothes. Machines having this type of cycle, or a variation thereof, generally produce highly satisfactory results in that the clothes come out properly cleaned and with a substantial part of the liquid removed.

In the case where clothes are extremely dirty or soiled with difficult to remove spots, they will emerge from the cycle of operations with at least some of those spots still visible. Generally, these exceptionally dirty clothes are a minority relative to a full wash. Thus, it would not be economical to add extra detergent to the full load of clothes just for the sake of cleaning an isolated heavily soiled item.

These types of clothes should be washed by themselves so that special treatment may be given to each item. One disadvantage which presents itself when very small loads are washed in the basket of a washing machine is that the amount of water required for washing a few items may be comparable to the amount of water used for washing several pounds of clothing. This, of course, represents an inefficient use of water with a resulting high cost of water and energy in heating the water in consideration of the results being obtained. Also, there is a correlary that the greater the quantity of water used, the greater the quantity of detergent needed in order to effect a proper detergent concentration in the water. This is even more critical in the instance of heavily soiled clothes which would require greater amounts of detergent. Considerations such as these have quite often led the owners of domestic clothes washing machines to do the washing of heavily soiled clothes by hand despite the availability of the machine.

One solution to this problem is the use of a small basket placed on the agitator inside the larger regular wash clothes basket. The motion of the agitator carries with it the small basket and provides a motion of the liquid in the basket which causes a suitable type washing action. This type of washing machine is described in U.S. Pat. No. 3,014,358 and is assigned to the assignee of the present invention. In the use of a small wash basket as described in U.S. Pat. No. 3,014,358 the clothes within the small basket are subjected to the same operational cycles as when the machine is used with a "normal" operation. The disadvantage in such a clothes washing cycle is that the water is continuously recirculated through the small basket. Accordingly, while the smaller basket has a relatively small volume the water level in the smaller basket is maintained by circulating all of the water in the machine machine through the smaller basket during the washing operation. This causes the detergent that is placed in the small basket to be diluted into the recirculating water in the machine.

By the present invention means are provided whereby during the washing cycle of operation only a predetermined volume of the fill water is circulated into the smaller basket during a timed recirculation cycle prior to the wash cycle. This relatively small volume of water is retained therein during the entire washing cycle of operation. This ability to confine a limited water volume allows for the attainment of a very high detergent concentration with the usage of reasonable and acceptable amount of detergent. Following this initial wash in a high detergent concentration the machine reverts to its "normal" cycle of operation; wherein all of the fill water in the machine is recirculated through the small basket during the ensuing spin, rinse, and extraction cycles of operation.

SUMMARY OF THE INVENTION

By the present invention there is provided a vertical axis clothes washing machine comprising a liquid and clothes containing means including a relatively large substantially imperforate outer receptacle, and a relatively large perforated clothes receptacle positioned within the receptacle. A removably mounted agitator extendes upwardly into the clothes receptacle. A drive system is provided for rotating the clothes receptacle and the agitator at a relatively high speed, including means for effecting a washing motion of the agitator. A water inlet means provides fresh water to the liquid and clothes containing means. A control terminates the flow of water from the inlet means and a washing motion of the agitator is initiated. Positioned on the agitator and movable therewith is a relatively small substantially imperforate basket which has overflow openings adjacent the top thereof. A recirculation pump including a conduit connected between an inlet in the outer receptacle and an outlet positioned for supplying liquid to the small imperforate basket are arranged to pump liquid from the outer receptacle through the outlet means. The control means is settable to provide a relatively high predetermined level of liquid when the clothes are to be washed in the clothes receptacle and settable to a relatively low liquid level when the clothes are to be washed in the small imperforate basket. Further, the control means includes valve means in the conduit for allowing a predetermined amount of liquid to flow through the outlet means whereby clothes contained in the small imperforate basket are washed in the predetermined amount of liquid independently of liquid in the outer receptacle.

DESCRIPTION OF THE INVENTION

Figure 1:
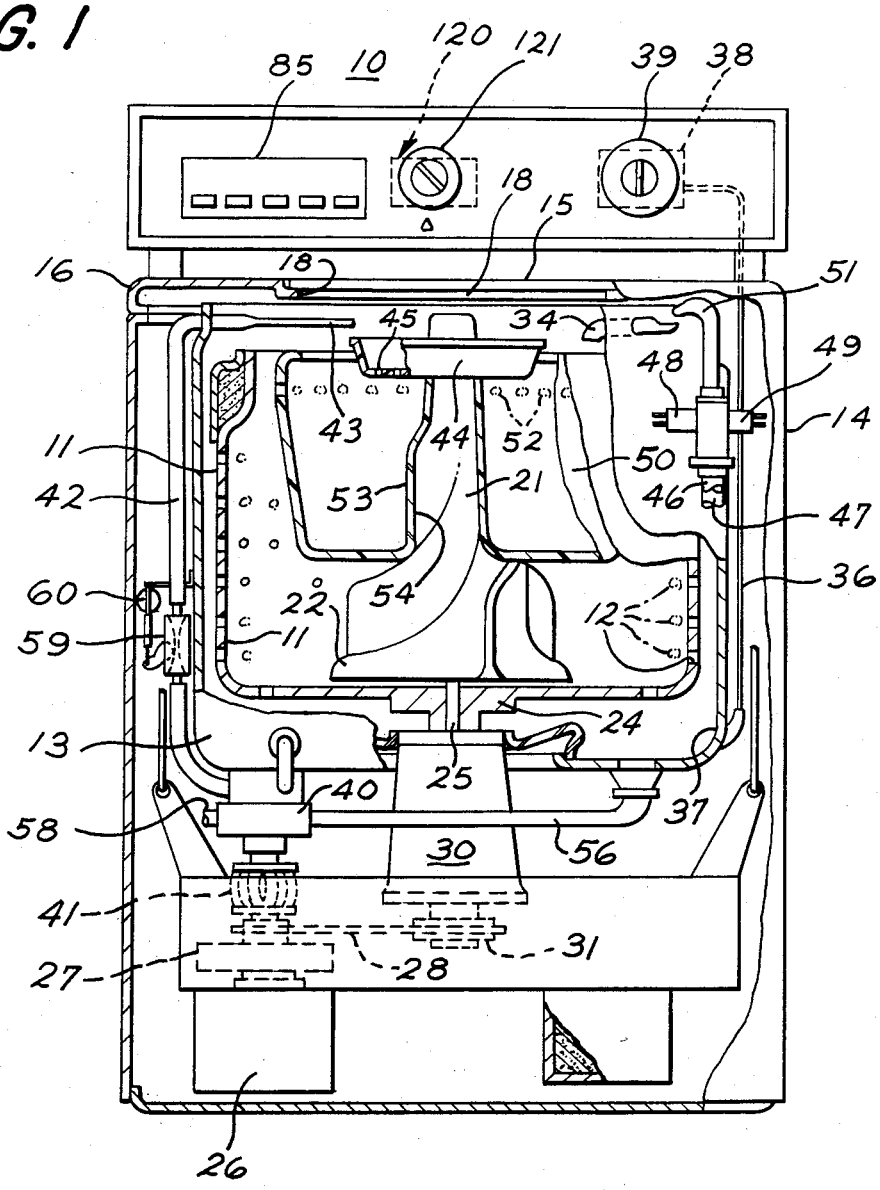
FIG. 1 is a front elevational view of a clothes washing machine incorporating the present invention, the view being partially broken away and partially in section to illustrate details.

Referring now to the drawings there is shown an agitator type clothes washing machine 10 having a conventional basket or clothes receiving receptacle 11 perforated over its side and bottom walls with perforations 12 and disposed within an outer imperforated tub 13. Tub 13 is mounted within an appearance cabinet 14 which includes a cover 15 hingedly mounted in the top portion 16 of the cabinet for providing access through an opening 18 to the basket 11. At the center of the basket 11 there is positioned a vertical axis agitator 20 which includes a center post 21 and a plurality of water circulating vanes joined at their lower ends by an outwardly flared skirt 22.

Both the clothes basket 11 and the agitator 20 are rotatably mounted. The basket 11 is mounted on a flange of a rotatable hub 24 and the agitator is mounted on a shaft 25 which extends upwardly through the hub and through the center post 21 and is secured to the agitator so as to drive it. During the cycle of operation of the machine the agitator 20 is first oscillated back and forth on its axis, that is, in a horizontal plane within the basket 11 to wash the clothes therein. Then after a predetermined period of this washing action the basket 11 is rotated at a high speed to extract centrifugally the washing liquid from the clothes and discharge it to drain as will be explained. Following this extraction operation a supply of clean water is introduced into the basket for rinsing the clothes and the agitator is again oscillated. Finally, the basket is once more rotated in high speed to extract the rinse water.

The basket 11 and agitator 20 may be driven by any suitable means as the drive means forms no part of the present invention. However, by way of example they are shown driven from a reversible motor 26. The motor 26 drives the basket 11 and the agitator 20 through a drive including a clutch 27 which is mounted on the motor shaft. The clutch 27 allows the motor 26 to start within a load and then to accept the load as it comes up to speed. A suitable belt 28 transmits power to a transmission assembly 30 through a pulley 31. Thus, depending upon direction of motor rotation the pulley 31 of the transmission is driven in opposite directions. Preferably, as will be more fully explained below, transmission clutch 27 is also a two-speed clutch. Specifically, in the illustrated machine the clutch 27 provides a direct drive between the motor 26 and the pulley 31 and a reduced speed drive to the pulley 31. The transmission 30 is so arranged that it supports and drives both the agitator drive shaft 25 and the basket mounting hub 24. When the motor 26 is rotated in one direction the transmission causes the agitator 20 to oscillate in a substantially horizontal plane within the basket 11. Conversely, when the motor 26 is driven in the opposite direction the transmission 30 rotates the wash basket 11 and agitator 20 together at high speed for centrifugal extraction. In order to introduce fresh water to the machine a suitable conduit 34 is provided having an outlet opening into the tub 13 so that suitable washing and rinsing liquid may be introduced in the desired quantities into the tub 13 and basket 11. It will at this point be noted that in the preferred construction shown the perforations 12 of the basket 11 cause the interior of the basket 11 to be in full communication with part of the tub 13 which is exterior to the basket 11 so that the liquid level in both the basket 11 and the tub 13 is the same. Thus, as the water rises in one it will also rinse in the other. With this type of structure suitable means may thus be provided in the tub 13 to determine when the appropriate water level in the basket 11 has been reached. In the present case this structure is provided in a conventional manner by means of a tube 36 which extends from an opening 37 adjacent the bottom of the tub 13 up to a pressure sensitive water level control 38 which may be of the conventional type.

In effect, in this type of water level control an electric switch is included in the device 38 and the switch is operated in response to an increase of the air pressure within the conduit 36. The increase in air pressure coming as a result of compression of air by a rise in the level of water in the tub 13. A further conventional embodiment of level control is the provision of means for varying the point at which the switch is closed by the air pressure so that any one of several different air pressures may be selected for the closing of the switch. In this manner different levels within the tub may be selected by movement of dial 39 to different positions. The water level content may be of the type wherein the water levels selected may be infinite or of the type wherein the selection is restricted to predetermined levels. In the present embodiment a 4-position control is employed. One position provides a level which substantially fills the basket 11, a second setting provides about two-thirds of a basket, a third setting shuts off the incoming water when it reaches about half the height of the basket, and the fourth lowest level which will be more fully discussed in connection with the present invention shuts off the incoming water when it reaches a very low level in the tub which may well not even rise to the bottom of the basket 11.

In the direction of rotation which is provided for the washing operations the motor 26 drives a pump 40 through a flexible coupling 41 in the appropriate direction to discharge liquid from the bottom of the tub 13 into a conduit 42 which leads to a nozzle 43. The nozzle 43 is positioned relative to a filtering member 44 secured on the top of the agitator 20 so as to be movable therewith so that liquid is recirculated by pump 40 hooked up through the conduit 42 and out of the nozzle 43 into the oscillating filter pan 44. It will be observed that the filter pan 44 has a substantial number of small openings 45 formed therein so that the water coming from the nozzle 43 passes down through the openings 45. The filter pan 44 with its many small openings and its upstanding side walls causes the lint, which is separated from the clothes during the washing operation, to be filtered out of the water and thus prevents it from being redeposited on the clothes.

Hot and cold water may be supplied to the machine through conduits 46 and 47 which are adapted to be connected respectively to sources of hot and cold water (not shown). Conduits 46 and 47 extend into a valve structure having solenoids 48 and 49 and being connected to a hose 51.

Also secured on the agitator so as to move therewith is a clothes containing basket 50 which is small relative to the basket 11 and the tub 13. The basket 50, except for overflow openings 52 adjacent the top thereof, is imperforate. The lower inner portion of the annular basket 50 may be formed to accommodate the tops of the vanes 54 of the agitator 20, in addition providing small washing vanes within the basket 50 itself. This positions the basket 50 securely on the agitator 20 so that there will not be any relative rotation of the two. The basket 50 is positioned below the filter pan 44 so that water which is poured into the filter pan from the nozzle 43 passes through the openings 45 in the filter pan 44 down into the basket 11. Thus, in effect the filter pan affects a filtering action of the water prior to its entry into the basket 11.

The filter pan 44 and basket 50 are preferably removably positioned on the agitator 20 so that they may be removed when so desired, for instance, for inserting clothes into the basket 11 and readily replaced on the agitator 20 secured thereto as to move therewith. It should be noted that the filter pan does not form a part of the present invention and its use is optional.

Completing the description of the structure, when enough washing has been provided and is intended to remove the washing liquid from the clothes the direction of rotation of the motor is reversed. As described above, this causes the basket 11 and agitator 20 to rotate together at a relatively high speed so as to centrifuge the washing liquid out through the openings 12. The washing liquid thus removed is caused by the pump 40 rotating in the reverse direction to the previous rotation thereof to discharge into a conduit 56. The conduit 56 is adapted for discharge to a drain line 58 so that the pump 40 is effective to drain the tub 13.

As mentioned herein above, the control member 38 may be used to provide four different water levels in the tub 13, three of them being operative to provide water within the basket 11 and one of them being at such a low level within the tub 13 that there is insufficient water in the basket 11 to provide any washing action. This last low water level is provided when generally it is desired to use the small basket 50 to wash a very small load which generally occurs when delicate or heavily soiled garments of the type which constitute a small minority of all clothes worn must be washed and there is insufficient quantity to justify the use of the large basket 11.

In accordance with the present invention the small basket 50 is adapted to be used, as will be explained fully hereinafter, to wash a small quantity of clothes in a very high detergent concentration relative to the amount of water in the basket 50. In this instance the use of the small basket and a high concentration of detergent enhances the stain removal capability of the washing machine.

Use of the basket 50 and its cycle of operation in washing a normal small quantity of clothes will now be described. When such a load is to be washed the small basket 50 is placed on the agitator mechanism as shown and the filter pan 44 is then placed over the small basket 50.

When the lowest liquid level selected is reached in the basket and outer tub as described the motor 26 starts operation in the direction suitable for moving the agitator mechanism. As described this also causes the pump 40 to operate in the direction to pump water up through the conduit 42 and out from the nozzle 43 into the filter pan 44. This water then passes through the openings 45 in the filter pan 44 down into the basket 50 containing a small quantity of clothes. Because the basket 50 is substantially imperforate the water quickly rises in the basket regardless of the fact that the basket 11 does not have any water or virtually no water in it. The water continues to rise in the basket 50 until it reaches substantially to the level of the overflow outlets 52.

As mentioned above, in accordance with the present invention provision is made to employ the small basket 50 to wash a small quantity of clothes having a heavy soil concentration in a relatively small volume of water. This enables the user to establish a high concentration of detergent while using a relatively small volume of water and detergent. To this end, circulation of liquid to the basket 50 is terminted once the liquid level reaches the overflow apertures 52. At this point in time, because of the relatively small volume of water in the basket 50 the clothes can readily be washed in a high concentration of detergent during a heavy soil removal cycle of operation while using reasonable amounts of detergent. To this end, a pinch valve 59 is provided which is operated by a solenoid 60 arranged in conduit 42. The solenoid 60 is energized to cut recirculation flow to the basket 50 after a predetermined amount of time. In carrying out the present invention as will be explained hereinafter the solenoid is activated to cut of the flow of water to basket 50 after 30 seconds which time was found appropriate to transfer a volume of water from tub 13 sufficient to fill the basket 50.

In the lowest water level selection the water volume in the outer tub and basket is greater than needed to fill the small basket 50. While it might result in using less water by filling the small basket directly, controlling the temperature of the wash water would be difficult if not impossible. This is especially true in selecting a hot water wash since the initial flow would normally be cold until the lines are purged. Because of the relatively small volume of water required to fill the small basket it will, in most instances, fill with cold water before the supply line is purged and the hot water reaches the basket 50.

Accordingly, in the present instance this problem is eliminated by first filling the outer tub and basket in the normal manner. This volume of water even at the lowest water setting is sufficient to purge the hot water supply line of cold water and still provide adequate hot water for the wash cycle.

Figure 2:
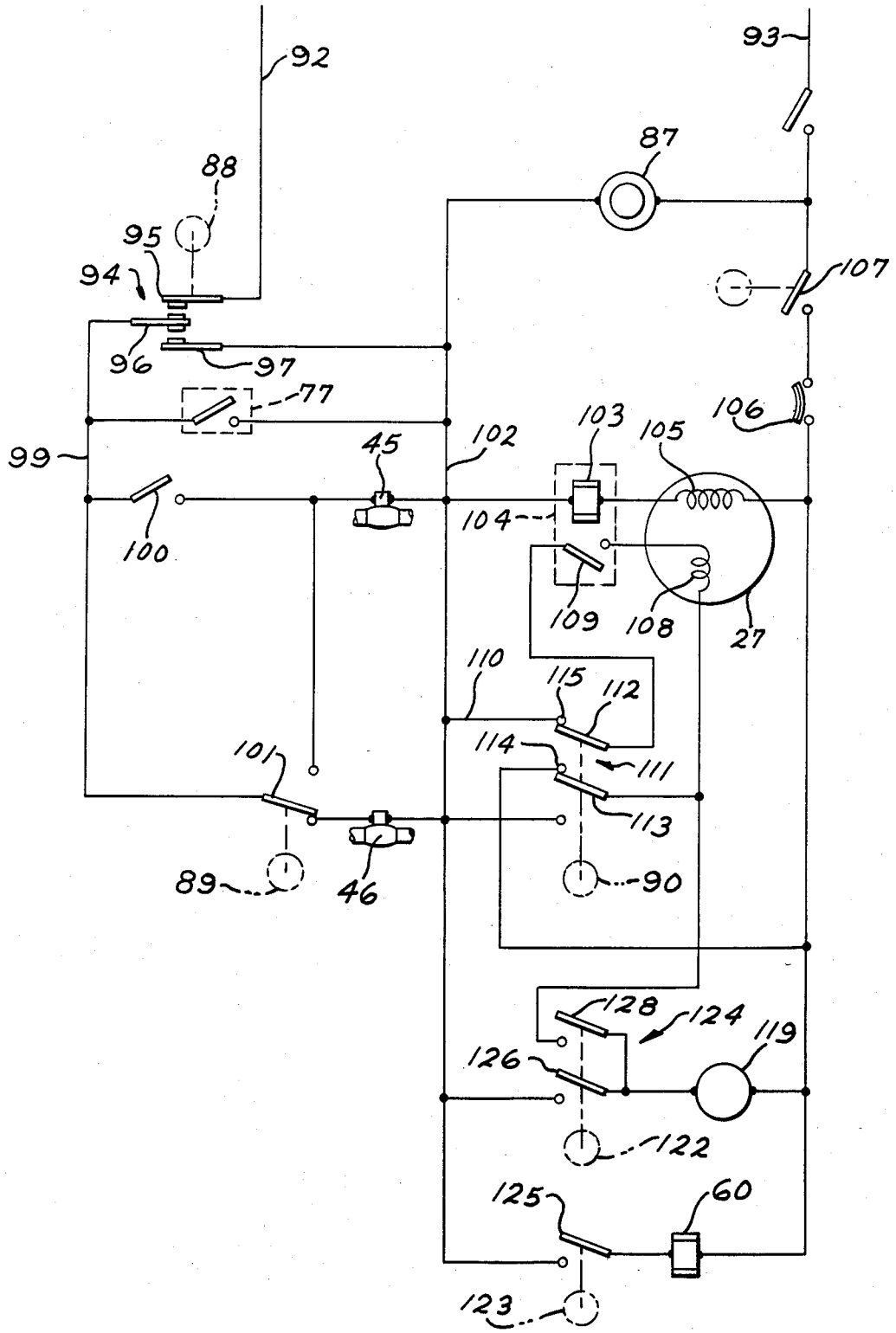
FIG. 2 is a schematic diagram of an electrical control circuit suitable for use with the machine of FIG. 1.

Completing now the description of the electrical control system for machine of FIG. 1, reference is made to FIG. 2. A sequence control assembly 85 (FIG. 1) includes a timer motor 87 which drives a plurality of cams 88, 89, 90 and 91. These cams during their rotation by the timer motor actuate various switches (as will be described), causing the machine to pass through the cycle of operation which includes washing, spinning, rinsing and spinning.

The electric circuit as shown in FIG. 2 is energized from a power supply (not shown) through a pair of conductors 92 and 93. Cam 88 controls a switch 94 which includes contacts 95, 96 and 97. When the cam has assumed the position where all three contacts are separated as shown, washer 10 is disconnected from the power source and is inoperative. When operation of washer 10 is to be initiated, as will be explained below switch 94 is controlled by cam 88 so that contacts 95 and 96 are energized. When a main switch 98 is closed (by any suitable manual control not shown), power is then provided to the control circuit of the machine from the conductor 92 through contacts 95 and 96. From contact 96 the circuit is completed from conductor 99 through switch 101 controlled by cam 89 and a manually operated switch 100. In the "up" position the switch 101 completes a circuit for the cold water solenoid 45 independently of switch 100; in the "down" position shown, the switch 101 completes a circuit for the hot water solenoid 46. Thus, when the switch 100 is open energization of solenoids 48 and 49 is under control of switch 101, but when switch 100 is closed the cold water solenoid may be energized independently of the position of switch 101.

From the hot and cold water solenids, the energizing circuit then extends through a conductor 102 and then to a coil 103 of a relay 104, the main or run windings 105 of motor 26, a conventional motor protector 106, a switch 107 controlled by cam 91, and the conductor 93.

Motor 27 is of the conventional induction type which is provided with a start winding 108 which assists the main winding 105. Current through relay 103 causes switch 109 to close, thereby energizing the start winding in parallel with the main winding through a conduit 110 of switch generally indicated at 111 and which is controlled by cam 90, contact arm 112, the relay contact 109, the start winding 108, a contact arm 113, and the contact 114 of switch 111.

A circuit is also completed in parallel with motor 27 through the timer motor 87. Relay 104 is designed to close contact 109 when a relatively high current is passing through it. When the main winding 105 of motor 27 is in series with valve solenoids 45 and 46, as described, a much lower impedance is presented in the circuit by the motor 27 than is presented by the valve solenoids. As a result, the greater portion of the supply voltage is taken up across the solenoids. This causes whichever of the solenoids is connected in the circuit to be energized sufficiently to open its associated water valve. This action continues with the circuits thus arranged, so that water is admitted to the basket 11 and tub 13. Because of the perforations in basket 11 the water rises in both basket 11 and tub 13 at the same rate.

Water level control switch 77 of water level control 38 is connected across conductors 99 and 102 as shown, so that when switch 77 closes, it excludes the solenoids 48 and 49 from the effective circuit by short circuiting them. As a result, the solenoids become de-energized and a high potential drop is provided across winding 105 of motor 27. This causes the relay 104 to close switch 109 to start the motor 27 while at the same time, timing motor 87 starts so as to initiate the sequence of operations. The switch 107 is in series with the main motor 27 but not in series with the timer motor 87. Thus, by the opening of switch 107, the energization of motor 27 may be stopped. The timer motor will continue to operate though, as a result of the fact that timer motor 27 is deliberately provided with an impedance much greater than the valve solenoids so that it will take up most of the supplied voltage and the solenoids therefore do not operate their respective valves.

A further point of the circuit of FIG. 2 is that when switch arms 112 and 113 are moved by cam 90 to engage contact 114 and a contact 115 respectively, the polarity of the start winding is reversed. The circuit from conductor 102 then proceeds through contact 115, contact arm 112 to start winding 108, relay contact 109, contact arm 113 and contact 114 to the protective device 106 and conductor 93. Thus, provided motor 27 is stopped or slowed down so that relay contact 109 is closed, the reversal of switch 111 is effective to cause the motor 27 to rotate in the opposite direction when the motor is started up again.

In order to energize motor 27 independently of the water level switch 77 and the valve solenoid, so that a spin operation may be provided without regard to the absence of the predetermined water valve, the cam 88 is formed so that it may close all three contacts 95, 96 and 97 of switch 94 during centrifugal water extraction. When this occurs, it causes the power to be supplied from conductor 92 directly through contact 97 to conductor 102 and the motor 27 rather than through the water level switch or the valve solenoids.

In the machine thus far described the small basket 50 provides means for isolating and confining a limited water volume in the range from 1.0 to 2.5 gallons during the activation or wash cycle of operation. This ability to confine a limited water volume in the wash cycle of operation allows for the attainment of very high detergent concentrations in the range from 0.8 to 3.3 weight percent based on the usage of reasonable and acceptable amount of detergent in the range from 75 to 125 grams. The high concentration of detergent achieved together with the agitation provided during the wash cycle of operation have been found to enhance washing performance significally. By way of comparison, these detergent concentrations were 8 to 33 times that commonly achieved in washing clothes in the larger clothes basket.

In carry out the wash cycle of operation in the small basket 50 in accordance with the present invention, a low water wash cycle control assembly 120 is provided. The control includes a manually settable dial 121. The dial 121 is used to initiate operation of a timer motor 119 which drives cams 122 and 123. These cams 122 and 123 during their rotation by the timer motor actuate switches 124 and 125 respectively. To initiate the controlled water level wash system in the small basket 50 the water level control 38 is set at the lowest water level position. The sequence control 85 is set in the normal manner to initiate a wash cycle, and the dial 121 is set so that switch contact 126 of switch 124 is closed.

Figure 3:
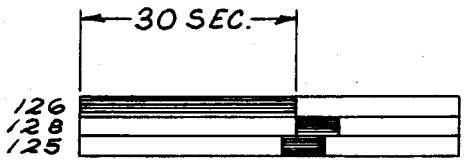
FIG. 3 is a schematic view of the cam surfaces used in the recirculation water control timer operated switches of FIG. 2.

At this point in time the solenoid 48 and 49 are energized and water fills into the tub to the lowest water level. As water level switch 77 closes shorting out the fill solenoids, power is made available to the motor 27 in the manner described above, and at the same time timer motor 119 is energized through line 102 and contact 126 of switch 124. The timer cam 122 is designed to maintain the operation of timer motor 119 through switch contact 126 for approximately 30 seconds, after which time the contact 126 opens to deenergize timer motor 119. During operation of the timer motor 119 the water in the tub 13 is recirculated in the normal manner to fill the small basket 50 as described above. At the time cam 122 opens the circuit to timer 119 cam 123 closes switch 125 to energize solenoid 60 of pinch valve 59. This prevents further recirculation of water from the tub 13 to the small basket 50 thereby insuring that clothes placed in basket 50 will in fact be washed in the limited or preselected volume of water. In carrying out the present invention it has been determined that the appropriate amount of water is transferred from the tub 13 to the basket 50 in the range of between 20 and 40 seconds. At the completion of the wash and the ensuing centrifugal extraction operation removes the water from basket 50 through openings 52. In the following rinse cycle water is once again introduced into the tub 13. When water level switch closes once again after this second fill, the switch 77 will close establishing a circuit to motor 27 to rinse the clothes in basket 50. At this time a circuit to the timer 119 is completed through cam switch 112, relay switch 109 and, the second contact 128 of switch 124. Once energized through contact 128 the timer motor 119 due to design of cam 126 will in effect run itself out, as indicated in the cam chart illustrated in FIG. 3. The opening of the circuit to timer 119 insures that the following cycles of operation including the rinse portion of the washing cycle will take place with the recirculation system operating. In effect during the remaining cycles of operation all of the fill water will be circulated through the clothes in basket 50. This insures that detergent even in the concentrated proportion will be rinsed or purged from the clothes during the remaining cycle of operations.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A vertical axis clothes washing machine having wash, rinse, and centrifugal extraction operations comprising:

liquid and clothes containing means including a relatively large substantially imperforate outer receptacle, and a relatively large perforated clothes receptacle positioned within said receptacle;

an agitator extending upwardly into said clothes receptacle;

means for rotating said clothes receptacle and said agitator at a relatively high speed during said centrifugal extraction operation;

means for effecting a washing motion of said agitator;

water inlet means for providing fresh water to said liquid and clothes containing means;

a control system including manually settable means for terminating the flow of water from said inlet means and for starting said means for effecting said washing motion of said agitator and said extraction operation;

a relatively small substantially imperforate basket positioned on said agitator and movable therewith;

means being manually settable to provide a relatively high level of water when clothes are to be washed in said clothes receptacle and settable to a relatively low water level when clothes are to be washed in said basket;

a liquid recirculation means including a conduit connected between an inlet in said outer receptacle and an outlet means positioned for supplying water to said basket, pumping means arranged to pump liquid from said outer receptacle through said outlet means; and recirculating water control means including valve means in said conduit operable for terminating the flow of water to said outlet means after a predetermined amount of time whereby clothes contained in said basket are washed in a selected volume of water independent of the volume of water in said receptacle.

2. The clothes washing machine recited in claim 1 wherein said recirculating water control means includes timer means having switch means operable for energized said valve means after a predetermined amount of time.

3. The clothes washing machine recited in claim 2 wherein said timer means includes means rendering said timer inoperable after said washing cycle, whereby said recirculation means functions uninterrupted during ensuing wash, rinse operations.

4. The clothes washing machine recited in claim 1 wherein said predetermined amount of time is between 20 and 40 seconds.

* * * * *